US010371017B2

(12) United States Patent
Sakakibara et al.

(10) Patent No.: US 10,371,017 B2
(45) Date of Patent: Aug. 6, 2019

(54) VALVE OPENING AND CLOSING TIMING CONTROL APPARATUS

(71) Applicant: AISIN SEIKI KABUSHIKI KAISHA, Kariya-shi, Aichi-ken (JP)

(72) Inventors: Toru Sakakibara, Kariya (JP); Yuji Noguchi, Obu (JP); Takeo Asahi, Kariya (JP); Hideyuki Suganuma, Anjo (JP); Hiroyuki Hamasaki, Obu (JP); Tomohiro Kajita, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 36 days.

(21) Appl. No.: 15/704,258

(22) Filed: Sep. 14, 2017

(65) Prior Publication Data

US 2018/0283228 A1 Oct. 4, 2018

(30) Foreign Application Priority Data

Mar. 30, 2017 (JP) ..... 2017-067641

(51) Int. Cl.
*F01L 1/344* (2006.01)
*F01L 1/46* (2006.01)
(Continued)

(52) U.S. Cl.
CPC ..... *F01L 1/344* (2013.01); *F01L 1/36* (2013.01); *F01L 1/46* (2013.01); *F02D 13/02* (2013.01); *F01L 2001/34483* (2013.01)

(58) Field of Classification Search
CPC ..... F01L 2001/34483
(Continued)

(56) References Cited

U.S. PATENT DOCUMENTS 9,074,497 B2 * 7/2015 Schulte ..... F01L 1/344
9,267,401 B2 2/2016 Noguchi et al.
(Continued)

FOREIGN PATENT DOCUMENTS

DE 102008007561 A1 8/2009
DE 102008051755 A1 4/2010
(Continued)

OTHER PUBLICATIONS

European Search Report dated May 15, 2018 issued by the European Patent Office in corresponding European Patent Application No. 17190990.6 (6 pages).

*Primary Examiner* — Jorge L Leon, Jr.
(74) *Attorney, Agent, or Firm* — Buchanan Ingersoll & Rooney PC

(57) ABSTRACT

A valve opening and closing timing control apparatus includes: a driving side rotator configured to rotate synchronously with a crankshaft of an internal combustion engine; a driven side rotator disposed coaxially with a rotation axis of the driving side rotator and configured to rotate integrally with a valve opening and closing camshaft; a phase controller configured to control a relative rotation phase between the driving side rotator and the driven side rotator by supply and discharge of a fluid; and a torsion spring configured to attain a biasing force to displace the relative rotation phase between the driving side rotator and the driven side rotator in a predetermined direction. The driving side rotator is fastened to a cover-shaped plate, and the torsion spring includes a first arm and a second arm.

4 Claims, 6 Drawing Sheets

(51) Int. Cl.
*F02D 13/02* (2006.01)
*F01L 1/36* (2006.01)

(58) Field of Classification Search
USPC ..... 123/90.17, 90.67
See application file for complete search history.

(56) References Cited

U.S. PATENT DOCUMENTS

2005/0252468 A1* 11/2005 Tanaka ..... F01L 1/022 123/90.17
2007/0000462 A1* 1/2007 Lee ..... F01L 1/344 123/90.17
2009/0069097 A1* 3/2009 Fischer ..... F01L 1/3442 464/1
2013/0233263 A1* 9/2013 Kinouchi ..... F01L 1/3442 123/90.17
2014/0069361 A1* 3/2014 Watanabe ..... F01L 1/053 123/90.15
2014/0202405 A1* 7/2014 Shinomiya ..... F01L 1/34409 123/90.15
2015/0053157 A1* 2/2015 Kandolf ..... F01L 1/3442 123/90.15
2015/0176442 A1* 6/2015 Kwak ..... F01L 1/34413 123/90.17
2015/0211391 A1* 7/2015 Bayrakdar ..... F01L 1/3442 123/90.15
2016/0222835 A1* 8/2016 Narita ..... B21D 39/06
2017/0002749 A1 1/2017 Sakakibara et al.
2017/0037748 A1* 2/2017 Sebald ..... F01L 1/3442

FOREIGN PATENT DOCUMENTS

JP 2009185762 A 8/2009
JP 2013-185459 A 9/2013
JP 2014-047778 A 3/2014

* cited by examiner

VALVE OPENING AND CLOSING TIMING CONTROL APPARATUS

CROSS REFERENCE TO RELATED APPLICATIONS

This application is based on and claims priority under 35 U.S.C. § 119 to Japanese Patent Application 2017-067641, filed on Mar. 30, 2017, the entire contents of which are incorporated herein by reference.

TECHNICAL FIELD

This disclosure relates to a valve opening and closing timing control apparatus having a torsion spring, which displaces a relative rotation phase between a driving side rotator and a driven side rotator in a predetermined direction by a biasing force.

BACKGROUND DISCUSSION

As a valve opening and closing timing control apparatus having the configuration described above, JP 2014-47778A (Reference 1) discloses a technology of having a torsion spring (a coil spring in Reference 1) over the driven side rotator (an inner rotor in Reference 1) and the driving side rotator (a housing in Reference 1). A biasing direction of the torsion spring is set so as to bias a relative rotation phase of the driven side rotator relative to the driving side rotator in an advance direction.

JP 2013-185459A (Reference 2) discloses a technology of providing a torsion spring (a coil spring in Reference 2) between a driving side rotator (a front plate in Reference 2) and a driven side rotator (a vane rotor in Reference 2) of a valve opening and closing timing control apparatus, thereby biasing the driven side rotator relative to the driving side rotator in an advance direction.

In a concrete configuration of Reference 2, a spring hook is provided on the front plate, a cylindrical bush is fixed to the vane rotor such that a portion thereof is embedded in the front plate, the entire torsion spring is disposed along the inner periphery of the bush, and the torsion spring has one end locked by the bush and the other end locked by the spring hook.

As a configuration in which the biasing force of the torsion spring is transmitted to the valve opening and closing timing control apparatus, for example, as described in Reference 2, when the spring hook is provided on the front plate, a process for attaching the spring hook is required, and by attaching the spring hook, a separate part (the spring hook) is required. In particular, when a configuration in which the spring hook is press-fitted into the front plate of the valve opening and closing timing control apparatus is adopted, an increase in the strength of the front plate, such as an increase in the thickness of the front plate, etc., is required.

In addition, for example, in the spring hook described in Reference 2, a portion of the torsion spring that is close to the front plate is deformed by the action of an external force so as to be lifted from the front plate (to be wholly compressed), the end of the torsion spring may be separated from the spring hook.

In order to cope with this problem, the spring hook may be formed in a long dimension in the direction along the rotation axis of the valve opening and closing timing control apparatus. However, when the spring hook is formed in a long dimension, because the spring hook is not only increased in size, but also is increased in weight, it is conceivable that rotation balance is deteriorated.

Such a problem exists in a valve opening and closing timing control apparatus having a torsion spring without limited to the configurations of Reference 1 and Reference 2, and there is room for improvement.

Thus, a need exists for a valve opening and closing timing control apparatus which is not susceptible to the drawback mentioned above.

SUMMARY

A feature of an aspect of this disclosure resides in that a valve opening and closing timing control apparatus includes a driving side rotator configured to rotate synchronously with a crankshaft of an internal combustion engine, a driven side rotator disposed coaxially with a rotation axis of the driving side rotator and configured to rotate integrally with a valve opening and closing camshaft, a phase controller configured to control a relative rotation phase between the driving side rotator and the driven side rotator by supply and discharge of a fluid, and a torsion spring configured to attain a biasing force to displace the relative rotation phase between the driving side rotator and the driven side rotator in a predetermined direction, wherein the driving side rotator is fastened to a cover-shaped plate, which contains the driven side rotator therein and covers the driven side rotator, via a fastening bolt, and a screwing structure that is screwed to the fastening bolt or a head portion of the fastening bolt is formed as a first hook portion that protrudes from the cover-shaped plate, and wherein the torsion spring includes a first arm provided on one end side thereof so as to be locked by the first hook portion and a second arm provided on a remaining end side thereof so as to be locked by a second hook portion of a locking member that rotates integrally with the camshaft.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be described with reference to the accompanying drawings.

Basic Configuration

Figure 1:
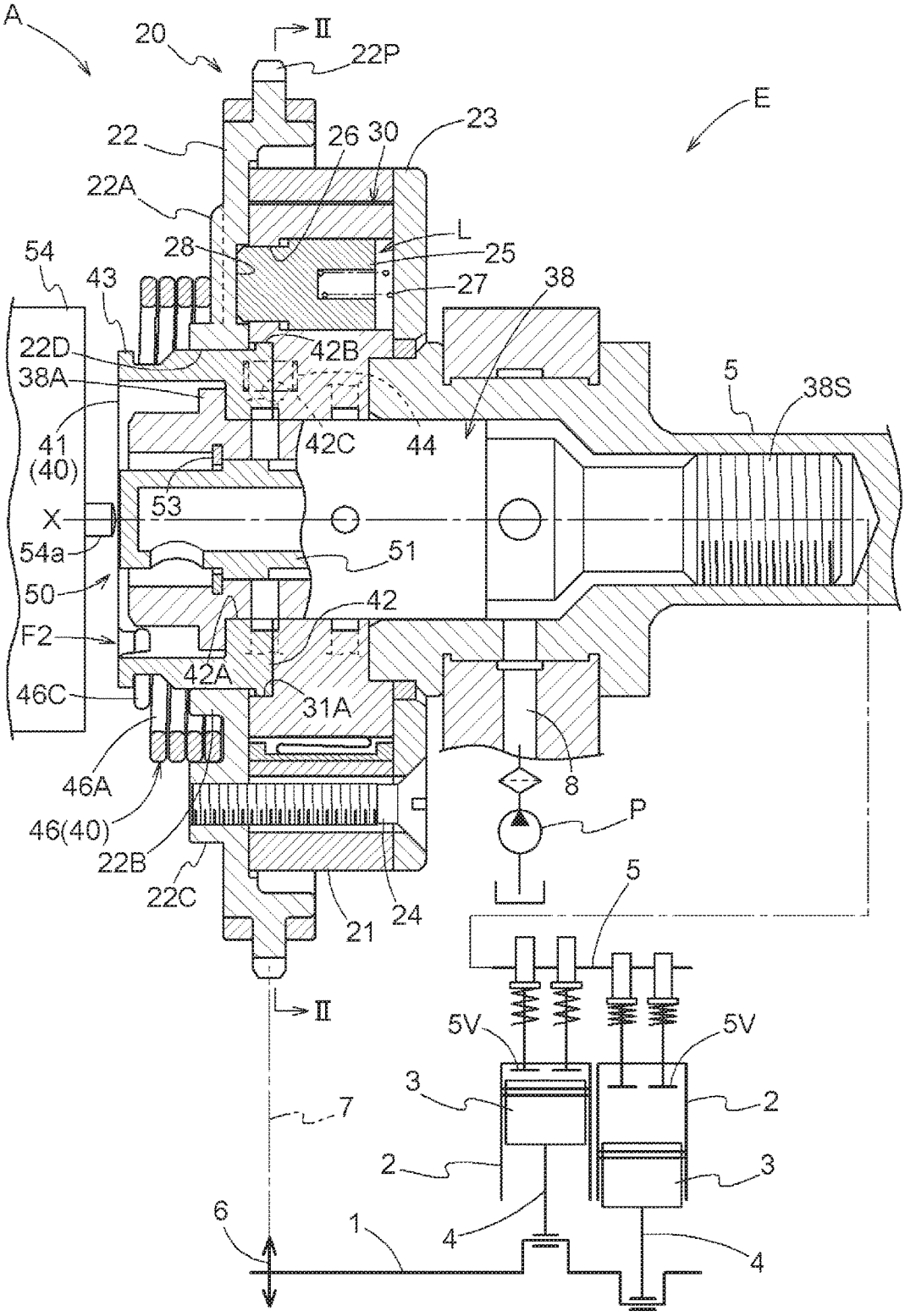
FIG. 1 is a cross-sectional view illustrating a valve opening and closing timing control apparatus.
Figure 2:
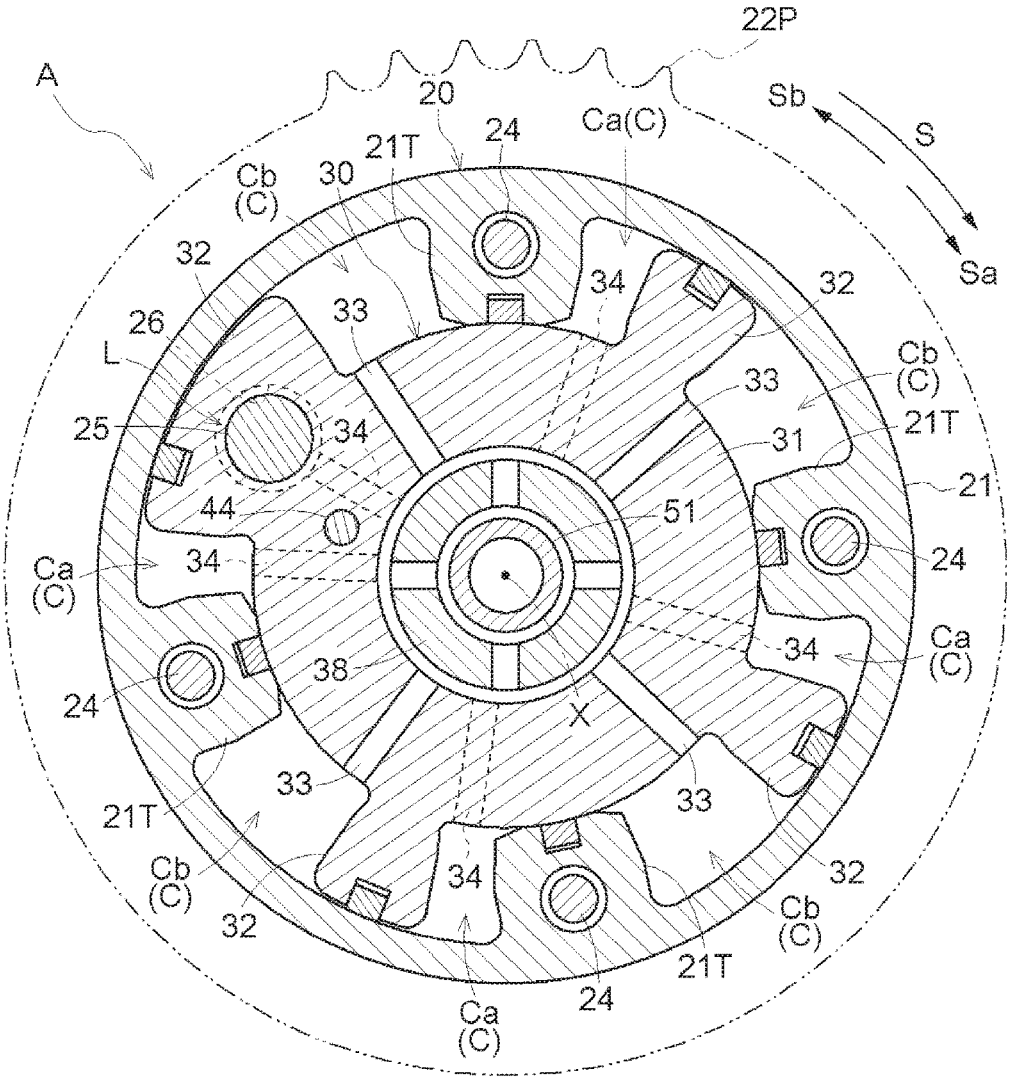
FIG. 2 is a cross-sectional view taken along line II-II of FIG. 1.

As illustrated in FIGS. 1 and 2, a valve opening and closing timing control apparatus A includes an outer rotor 20 as a driving side rotator, an inner rotor 30 as a driven side rotator, a biasing unit 40, and an electronic control valve 50 as a phase controller.

The outer rotor 20 (an example of the driving side rotator) is disposed coaxially with the rotation axis X of an intake camshaft 5 of an engine E that is an internal combustion engine, and is linked to a crankshaft 1 via a timing chain 7 so as to rotate synchronously with the crankshaft 1. The inner rotor 30 (an example of the driven side rotator) is included in the outer rotor 20 and is connected to the intake camshaft 5 via a connection bolt 38. Thus, the inner rotor 30 rotates integrally with the intake camshaft 5.

The biasing unit 40 includes a torsion spring 46, and the torsion spring 46 applies a biasing force to displace a relative rotation phase between the outer rotor 20 and the inner rotor 30 in an advance direction from a maximum retardance phase. The electronic control valve 50 (an example of the phase controller) changes the relative rotation phase between the outer rotor 20 and the inner rotor 30 by supplying a hydraulic oil to an advance chamber Ca and a retardance chamber Cb, which are formed between the outer rotor 20 and the inner rotor 30, thereby performing control of the opening and closing timing of an intake valve 5V.

The engine E (an example of an internal combustion engine) is provided in a vehicle, such as an automobile, etc. The engine E is configured in a four-cycle form in which the crankshaft 1 is provided in the lower region and pistons 3 are accommodated in cylinder bores formed in a cylinder block 2 in the upper region so that each piston 3 is connected to the crankshaft 1 via a connecting rod 4.

The outer rotor 20 rotates synchronously with the crankshaft 1 by winding the timing chain 7 around an output sprocket 6 formed on the crankshaft 1 of the engine E and a timing sprocket 22P of the outer rotor 20. Although not illustrated in the drawings, a timing sprocket is also provided on the front end of a camshaft on the exhaust side, and the timing chain 7 (this may also be a timing belt) is wound around the timing sprocket.

In the present embodiment, although the valve opening and closing timing control apparatus A is provided on the intake camshaft 5, the valve opening and closing timing control apparatus A may be provided on the exhaust camshaft, or may be provided on both the intake camshaft 5 and the exhaust camshaft.

The engine E includes a hydraulic pump P, which supplies, as the hydraulic oil, a lubrication oil stored in an oil pan of the engine E, and the hydraulic oil is supplied from the hydraulic pump P to the electronic control valve 50 through a supply flow path 8.

As illustrated in FIG. 2, in the valve opening and closing timing control apparatus A, the outer rotor 20 rotates toward a driving rotation direction S by a driving force of the crankshaft 1. In addition, a direction in which the inner rotor 30 rotates relative to the outer rotor 20 in the same direction as the driving rotation direction S is referred to as an advance direction Sa, and an opposite direction thereof is referred to as a retardance direction Sb.

Valve Opening and Closing Timing Control Apparatus

Figure 3:
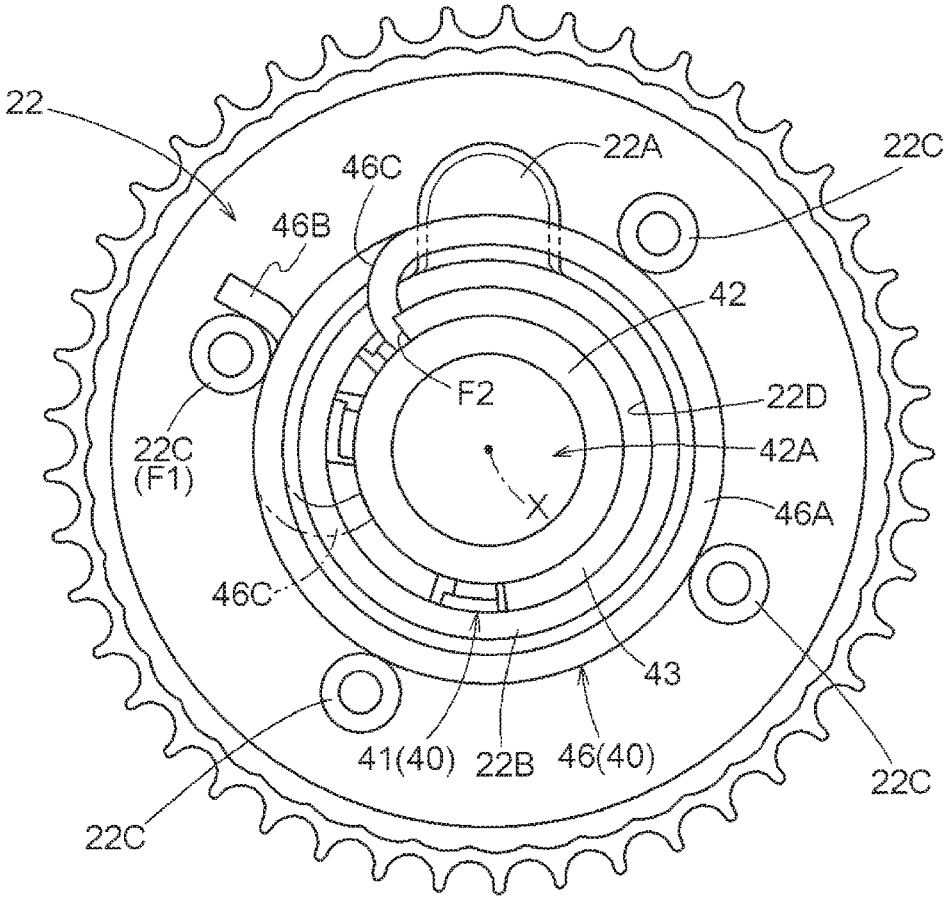
FIG. 3 is a view illustrating the valve opening and closing timing control apparatus viewed from the front plate side.

As illustrated in FIGS. 1 to 3, the outer rotor 20 includes an outer rotor body 21, a front plate 22 (an example of a cover-shaped plate), and a rear plate 23, which are fixed via fastening of a plurality of fastening bolts 24. The timing sprocket 22P is formed on the outer periphery of the front plate 22.

The outer rotor body 21 is integrally formed with a plurality of partitions 21T, which protrudes inward in the radial direction and is disposed at a position at which it is sandwiched between the front plate 22 and the rear plate 23.

The inner rotor 30 includes a cylindrical inner rotor body 31, and a plurality of (four) vane portions 32, which protrudes outward in the radial direction from the outer periphery of the inner rotor body 31.

Accordingly, in a state where the inner rotor body 31 is fitted into the outer rotor body 21, a plurality of (four) fluid pressure chambers C is formed between the outer rotor body 21 and the inner rotor body 31, and each fluid pressure chamber C is divided by the vane portion 32 to form the advance chamber Ca and the retardance chamber Cb.

As illustrated in FIG. 1, the connection bolt 38 includes a bolt head portion 38A and a male screw portion 38S, and connects the inner rotor 30 to the intake camshaft 5 as the male screw portion 38S is screwed to a female screw portion of the intake camshaft 5. In particular, in the connected state, the bolt head portion 38A is pressed against a seat part 42 of a spring holder 41 (an example of a locking member) to be described below, so that the spring holder 41, the inner rotor 30 and the intake camshaft 5 are integrated with one another.

Moreover, the connection bolt 38 includes a cylindrical portion having a cylindrical shape about the rotation axis X on the outer end side thereof (the left side in FIG. 1), and a spool 51 of the electronic control valve 50 and a spool spring (not illustrated), which biases the spool in a protruding direction, are accommodated in the space inside the cylindrical portion.

Figure 4:
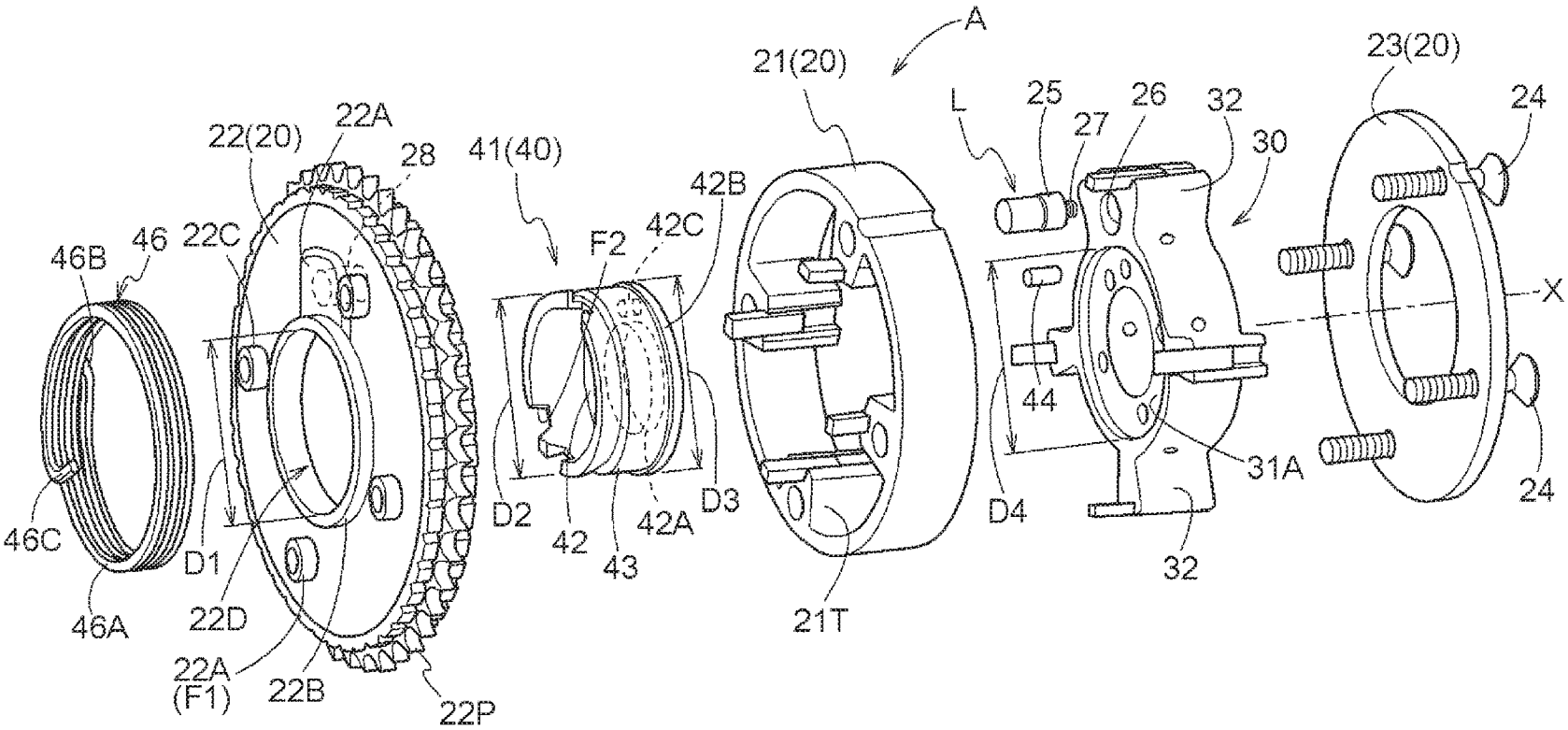
FIG. 4 is an exploded perspective view of the valve opening and closing timing control apparatus.

The valve opening and closing timing control apparatus A includes a lock mechanism L, which locks (maintains) the relative rotation phase between the outer rotor 20 and the inner rotor 30 in a maximum retardance phase. As illustrated in FIGS. 1, 2 and 4, the lock mechanism L includes a lock member 25, which is slidably accommodated in a guide hole 26, which is formed in one vane portion 32 in a posture along the rotation axis X, a lock spring 27, which biases the lock member 25 so as to protrude, and a lock recess 28 formed in the front plate 22.

With this configuration, when the relative rotation phase has reached the maximum retardance phase, the lock member 25 moves along the direction of the rotation axis X and engages with the lock recess 28 by a biasing force of the lock spring 27, thereby reaching a locked state. In addition, the lock recess 28 is in communication with an advance flow path 34, as illustrated in FIG. 2, and when the hydraulic oil is supplied to the advance flow path 34 in a situation where the lock mechanism L is in the locked state, the lock member 25 is separated from the lock recess 28 against the biasing force of the lock spring 27 and the locked state is released.

When the engine E operates, a fluctuation torque acting from the intake camshaft 5 acts in the retardance direction Sb. In addition, when starting the engine E, it is necessary to rapidly displace the relative rotation phase in an advance direction even in a situation where the supply of hydraulic oil from the hydraulic pump P is not sufficient as in the case immediately after the locked state of the locking mechanism L is released. From these viewpoints, the biasing direction of the biasing unit 40 is set to the advance direction Sa in order to assist in the displacement of the relative rotation phase in the advance direction Sa. A configuration of the biasing unit 40 will be described below.

Valve Opening and Closing Timing Control Apparatus: Oil Passage Configuration

As illustrated in FIGS. 1 and 2, the space in which the relative rotation phase is displaced in the advance direction Sa by the supply of hydraulic oil is the advance chamber Ca, and conversely, the space in which the relative rotation phase is displaced in the retardance direction Sb by the supply of hydraulic oil is the retardance chamber Cb. A relative rotation phase in a state where the vane portion 32 has reached an operating end thereof in the advance direction Sa (including the phase near the operating end of the vane portion 32 in the advance direction Sa) is referred to as a maximum advance phase, and a relative rotation phase in a state where the vane portion 32 has reached an operating end thereof in the retardance direction Sb (including the phase near the operating end of the vane portion 32 in the retardance direction Sb) is referred to as a maximum retardance phase.

In the inner rotor body 31, a retardance flow path 33, which is in communication with the retardance chamber Cb, and an advance flow path 34, which is in communication with the advance chamber Ca, are formed. In addition, the advance flow path 34 is in communication with the lock recess 28.

Electronic Control Valve: Oil Passage Configuration

As illustrated in FIG. 1, the electronic control valve 50 includes the spool 51, a spool spring (not illustrated), and an electronic solenoid 54. The electronic control valve 50 functions as the phase controller, sets the position of the spool 51 under the control of the electronic solenoid valve 54, thereby controlling the supply and discharge of hydraulic oil to and from the advance chamber Ca and the retardance chamber Cb and setting the relative rotation phase.

The spool 51 is disposed in the space inside the connection bolt 38 so as to slide in the direction along the rotation axis X, and a stopper 53, which is configured with a retaining ring, is provided on the connection bolt 38 in order to determine the operating position of the outer end side of the spool 51. The spool spring applies a biasing force in a direction such that the spool 51 is spaced apart (protrudes) from the intake camshaft 5.

The electronic solenoid 54 includes a plunger 54*a*, which protrudes by an amount that is proportional to electric power supplied thereto, and operates the spool 51 by a pressure force of the plunger 54*a*. In addition, the spool 51 is supported so as to rotate simultaneously with the inner rotor 30, and the electronic solenoid 54 is supported by the engine E so as not to rotate.

The plunger 54*a* of the electronic solenoid 54 is disposed at a position where it may come into contact with the outer end of the spool 51, and the spool 51 is held at a retardance position illustrated in FIG. 1 in a state the electronic solenoid 54 is de-energized. In addition, in a state where predetermined electric power is applied to the electronic solenoid 54, the plunger 54*a* moves to the inner end side and the spool 51 is held at an advance position. Moreover, when electric power lower than electric power required to set the advance position is applied to the electronic solenoid 54, the spool 51 is held at a neutral position that is an intermediate position between the advance position and the retardance position.

Inside the connection bolt 38, a flow path is formed to control a fluid from the hydraulic pump P by the position of the spool 51 so as to supply the fluid to any one of the retardance flow path 33 and the advance flow path 34. Therefore, for example, when the spool 51 is operated to the advance position, the hydraulic oil is supplied from the hydraulic pump P to the advance chamber Ca through the advance flow path 34, and the hydraulic oil is discharged from the retardance chamber Cb through the retardance flow path 33. Thus, the relative rotation phase is displaced in the advance direction Sa.

In addition, when the neutral position is set, the hydraulic oil is not supplied to both the advance chamber Ca and the retardance chamber Cb, and the relative rotation phase is maintained. In addition, when the spool 51 is operated to the retardance position, the hydraulic oil from the hydraulic pump is supplied to the retardance chamber Cb through the retardance flow path 33, and the hydraulic oil from the advance chamber Ca is discharged through the advance flow path 34. Therefore, the relative rotation phase is displaced in the retardance direction Sb.

Valve Opening and Closing Timing Control Apparatus: Biasing Unit

As illustrated in FIGS. 1 and 3 to 5, the biasing unit 40 includes the spring holder 41 (an example of a locking member) fixed to the inner rotor 30, and the torsion spring 46 supported on the spring holder 41.

The torsion spring 46 includes a coil portion 46A, a first arm 46B having an arm shape at one end side, and a second arm 46C having an arm shape at the other end side.

The spring holder 41 is integrally formed with the seat part 42, which is connected to the inner rotor body 31, and a cylindrical protrusion 43, which has a posture to protrude along the rotation axis X from the seat part 42. A second hook portion F2 is formed by cutting a portion of the protruding side edge of the protrusion 43.

In addition, a portion of the spring holder 41 near the outer end is formed to have a smaller diameter, and is formed with an anti-separation portion 43D, which regulates displacement of the second arm 46C in a direction such that the second arm 46C, which is locked by the second hook portion F2, is spaced apart from the front plate 22.

An insertion through-hole 42A, through which the connection bolt 38 is inserted, is formed in the center position of the seat part 42, and an annular protrusion 42B is formed on the outer peripheral position of the seat part 42 so as to protrude outward in the radial direction. The annular protrusion 42B, as illustrated in FIG. 1, is disposed at a position at which it is fitted between the fitting recess 31A of the inner rotor 30 and the front plate 22.

Moreover, a fixing pin 44 is press-fitted and fixed to the surface of the inner rotor 30 that faces the seat part 42, and a pin hole 42C, into which the fixing pin 44 is fitted, is formed in the surface of the seat part 42 that faces the inner rotor 30. With this structure, the fixing pin 44 integrally rotates the inner rotor 30 and the spring holder 41.

A bolt screwing portion 22C (an example of a screwing structure), which serves as a cylindrical boss having a female screw, which is screwed to a male screw of the fastening bolt 24 inserted from the side of the rear plate 23, is integrally formed on the front plate 22 so as to protrude from the outer surface. In addition, one of a plurality of bolt screwing portions 22C function as a first hook portion F1 that locks the first arm 46B.

The front plate 22 is formed with a regulation convex portion 22A, which protrudes from the outer surface of the front plate 22 to regulate movement of the torsion spring 46 along the rotation axis X. The regulation convex portion 22A comes into contact with a portion of the coil portion 46A, which is spaced apart from the first hook portion F1, in the circumferential direction in a state where the first arm 46B of the torsion spring 46 is locked by the first hook portion F1, thereby functioning to stabilize the posture of the entire torsion spring 46.

A through-hole 22D is formed in the center of the front plate 22, and a guide portion 22B is formed, along the through-hole 22D, as an area that takes the form of a cylinder that is upright along the rotation axis X. The outer diameter of the guide portion 22B is set to a value slightly larger than the inner periphery of the coil portion 46A of the torsion spring 46.

In addition, as illustrated in FIG. 4, the inner diameter of the through-hole 22D is set to a hole diameter D1. The outer diameter D2 of the spring holder 41 is set to be slightly smaller than the hole diameter D1, and the outer end diameter D3 of the outer peripheral edge of the annular protrusion 42B of the spring holder 41 is set to be larger than the hole diameter D1.

In addition, the inner peripheral diameter D4 of the fitting recess 31A of the inner rotor body 31 is set to a value slightly larger than the outer end diameter D3. In addition, the inner diameter of the coil portion 46A of the torsion spring 46 is set to a value sufficiently larger than the outer diameter D2 of the spring holder 41.

Anti-Separation Component of Biasing Unit

Figure 5:
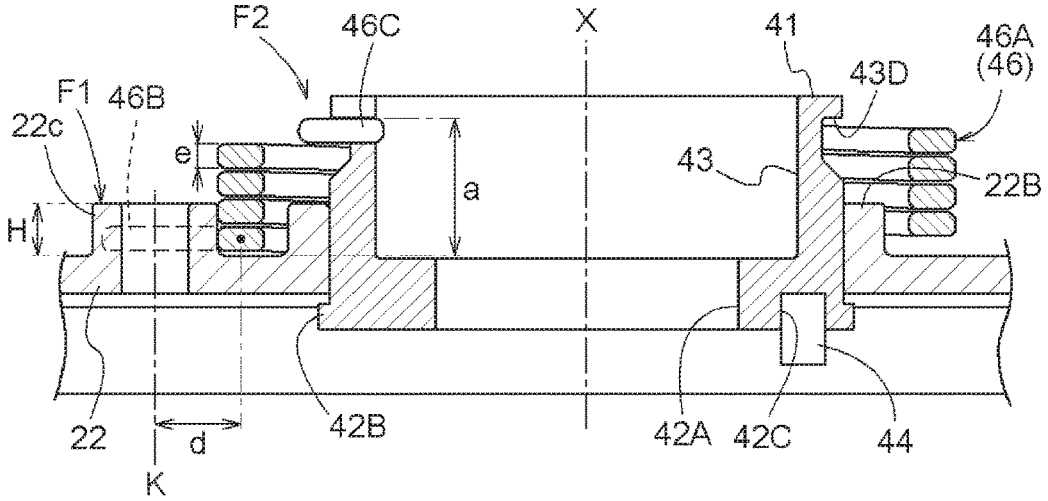
FIG. 5 is a cross-sectional view illustrating a torsion spring and a front plate.
Figure 6:
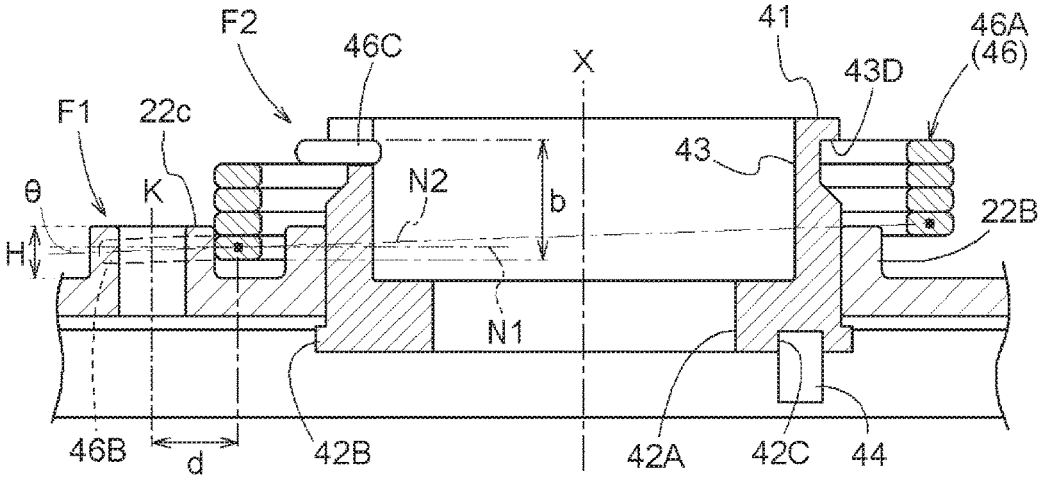
FIG. 6 is a view illustrating positions of a first hook portion and a second hook portion.

As illustrated in FIGS. 1, 5 and 6, the above-described anti-separation portion 43D is formed near the outer end of the spring holder 41.

In the valve opening and closing timing control apparatus A, as illustrated in FIG. 5, the lower limit value of the locking height H of the first hook portion F1 from the surface of the front plate 22 is obtained based on the calculation of the following equation. The distance from the surface of the front plate 22 to the outer surface of a spring material of the second arm 46C (the upper surface in FIG. 5) locked by the second hook portion F2 is set as a reference height a.

As illustrated in FIG. 6, in a situation where the second arm 46C is locked by the second hook portion F2, the close contact state of the torsion spring 46 as when the first arm 46B is lifted is assumed. In the close contact state, the distance from the outer surface (the lower surface in FIG. 6) of the spring material at the proximal end position of the first arm 46B to the outer surface (the upper surface in FIG. 6) of the spring material at the proximal end position of the second arm 46C is assumed to a close contact length b. Moreover, the thickness of the spring material is assumed to a spring material thickness e (that coincides with the diameter when the cross section of the spring material has a circular shape).

In addition, the amount of displacement in the direction along the rotation axis X from the proximal end position of the first arm 46B in the close contact state of the torsion spring 46 to the position at which the first arm 46B comes into contact with the outer surface of the first hook portion F1 is assumed to a correction value c. By setting the reference height a, the close contact length b, the spring material thickness e in the direction along the rotation axis X, and the correction value c as described above, the minimum value of the locking height H is determined based on an equation of $H \geq a-b+(e/2)-c$.

The locking height H obtained as described above is the lower limit value by which the first arm 46B is securely locked by the first hook portion F1 even when the torsion spring 46 has reached the close contact state thereof.

Because the cross-sectional shape of the spring material that forms the torsion spring 46 is oval, a portion of the first arm 46B that comes into contact with the first hook portion F1 has a semicircular shape. For this reason, the position at which the first arm 46B comes into contact with the first hook portion F1 is obtained by adding a half value (e/2) of the spring material thickness e (e/2) to a value (a−b).

In addition, because the first hook portion F1 has a circular shape when viewed in the direction along the rotation axis X, the locking position K of the first arm 46B with respect to the first hook portion F1, as illustrated in FIG. 5, overlaps the center of the bolt screwing portion 22C in the radial direction.

The correction value c is acquired by Equation of $c=d\times\tan\theta$ when the distance from the proximal end position of the first arm 46B to the locking position K of the first hook portion F1 is assumed to an arm length d and the angle of the first arm 46B relative to the front plate 22 is assumed to an inclination angle θ.

Figure 7:
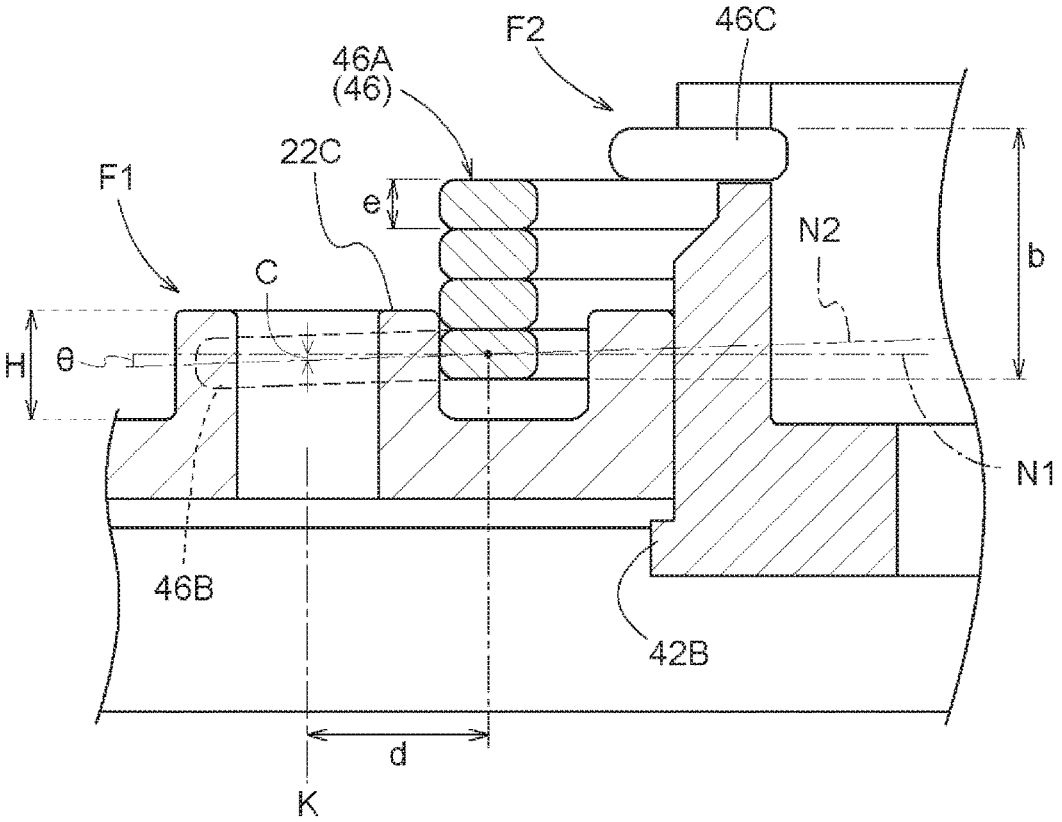
FIG. 7 is a view illustrating a relationship between the first hook portion and the second hook portion when the torsion spring is in close contact.

In the usual torsion spring 46, the inclination angle θ, which is the angle at which a reference line N1 in a posture parallel to the surface of the front plate 22 crosses an inclined line N2 of the coil portion 46A of the torsion spring 46, as illustrated in FIGS. 6 and 7, is inclined such that the tip end side of the first arm 46B approaches the front plate 22. For this reason, Equation of $H \geq a-b+(e/2)-c$ is set.

For example, in a case where the first arm 46B is titled from the proximal end position in the direction such that the tip end side is lifted (inclination angle—θ), contrary to the above description, as in a case where the first arm 46B is processed, the sign of the correction value c becomes negative based on Equation of $\tan(-\theta)=-\tan\theta$, and the minimum value of the locking height H is determined using the above-described equation of $H \geq a-b+(e/2)-c$.

In particular, the correction value c is a relatively small value and the first arm 46B is in a general inclined posture, because the correction value c reduces the locking height H, There is no practical problem when the lower limit value of the locking height H is obtained based on Equation of $H \geq a-b+(e/2)$.

When the lower limit value of the locking height H of the first hook portion F1 is determined as described above, even if the torsion spring 46 reaches a compressed state by the action of an external force such as vibration, the first arm 46B is kept at the position at which it is locked by the first hook portion F1, and there is no case where the first arm 46B is separated from the first hook portion F1.

In addition, because the anti-separation portion 43D is formed on the spring holder 41, even if the second arm 46C is displaced in the direction such that it is unlocked from the second hook portion F2 by the action of an external force such as vibration, there is no case where the second arm 46C is separated from the second hook portion F2.

Figure 8:
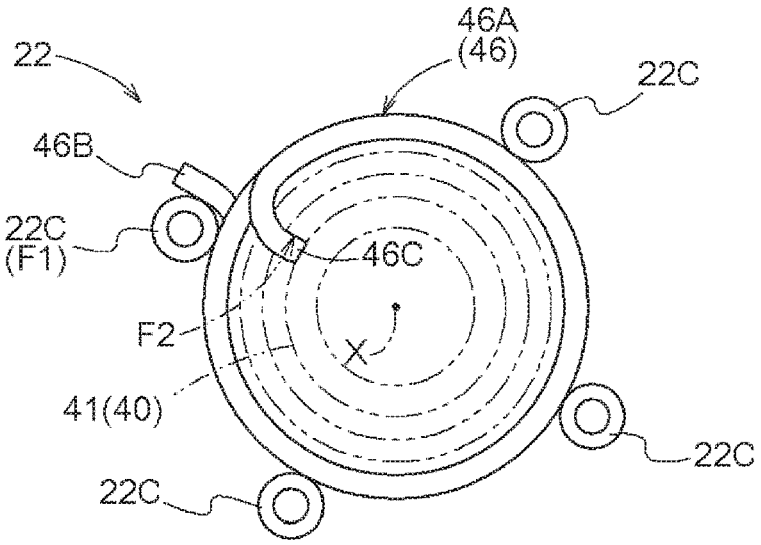
FIG. 8 is a view illustrating a first arm portion and a second arm portion, which have an overlapping relationship.

In FIG. 3, the position of the second arm 46C when the relative rotation phase is in the maximum retardance phase is indicated by a solid line, and the position of the second arm 46C when the relative rotation phase has reached the maximum retardance phase is indicated by a two-dot dashed line. As can be understood from FIG. 3, in the biasing unit 40, as illustrated in FIG. 8, an area where the relative rotation phase ranges from the maximum advance phase to the maximum retardance phase when viewed in the direction along the rotation axis X is set such that a relationship in which the first arm 46B and the second arm 46C overlap each other appears.

With this configuration, when the relative rotation phase is displaced to reach a positional relationship in which the second arm 46C overlaps with the first arm 46B, the second arm 46C regulates displacement of the first arm 46B in the lifting direction thereof, therefore separation of the first arm 46B from the first hook portion F1 is suppressed.

In particular, in this configuration, in a state where of being connected to the intake camshaft 5 by the connection bolt 38, the seat part 42 of the spring holder 41 is fitted into the fitting recess 31A of the inner rotor body 31 and the annular protrusion 42B of the outer periphery of the seat part 42 comes into close contact with the outer peripheral edge of the fitting recess 31A. Thus, the posture of the spring holder 41 is determined.

In addition, in a state where the torsion spring 46 is disposed, a portion of the coil portion 46A that is closest to the front plate 22 is disposed in the area that surrounds the outer periphery of the guide portion 22B, the outer periphery of the coil portion 46A comes into contact with the plurality of (four) bolt screwing portions 22C, and the position of the torsion spring 46 is determined. Moreover, a portion of the coil portion 46A comes into contact with the regulation convex portion 22A, so that the posture of the torsion spring 46 is stabilized.

By setting the lower limit value of the locking height H of the first hook portion F1 to the above value, the locked state may be maintained even in the close contact state of the torsion spring 46. Therefore, even when vibrations are applied or the outer diameter of the coil portion 46A slightly varies depending on the displacement of the relative rotation phase, a state where the first arm 46B is engaged with the first hook portion F1 is maintained. Thus, separation of the torsion spring 46 may be suppressed and the relative rotation phase may be appropriately applied in the advance direction.

Other Embodiments

The embodiments disclosed here may be configured as follows, in addition to the above-described embodiment (the same numbers and reference numerals will be given to those having the same functions as the embodiment).

(a) Instead of the spring holder 41 (an example of a locking member), for example, a cylindrical portion, which protrudes outward through a hole in the center of the front plate 22, may be integrally formed with the inner rotor 30. When the cylindrical portion is formed in this manner, the cylindrical portion functions as a spring holding portion.

(b) The fastening bolt 24 is configured to be inserted from the front plate 22 toward the rear plate 23, and a head portion of the fastening bolt 24 is referred to as the first hook portion F1. Even with such a configuration, the head portion of the fastening bolt 24, which protrudes from the front surface of the front plate 22, may be used as the first hook portion F1.

This disclosure may be used in a valve opening and closing timing control apparatus having a torsion spring, which biases a relative rotation phase between a driving side rotator and a driven side rotator in a predetermined direction.

A feature of an aspect of this disclosure resides in that a valve opening and closing timing control apparatus includes a driving side rotator configured to rotate synchronously with a crankshaft of an internal combustion engine, a driven side rotator disposed coaxially with a rotation axis of the driving side rotator and configured to rotate integrally with a valve opening and closing camshaft, a phase controller configured to control a relative rotation phase between the driving side rotator and the driven side rotator by supply and discharge of a fluid, and a torsion spring configured to attain a biasing force to displace the relative rotation phase between the driving side rotator and the driven side rotator in a predetermined direction, wherein the driving side rotator is fastened to a cover-shaped plate, which contains the driven side rotator therein and covers the driven side rotator, via a fastening bolt, and a screwing structure that is screwed to the fastening bolt or a head portion of the fastening bolt is formed as a first hook portion that protrudes from the cover-shaped plate, and wherein the torsion spring includes a first arm provided on one end side thereof so as to be locked by the first hook portion and a second arm provided on a remaining end side thereof so as to be locked by a second hook portion of a locking member that rotates integrally with the camshaft.

With this configuration, when the first arm of the torsion spring is locked by the first hook portion that protrudes from the cover-shaped plate and the second arm is locked by the second hook portion of the locking member, a biasing force of the torsion spring may be applied to the driving side rotator and the driven side rotator. In addition, because the screwing structure that is screwed to the fastening bolt or the head portion of the fastening bolt becomes the first hook portion that protrudes from the cover-shaped plate, it is unnecessary to attach a spring hook for locking the first arm of the torsion spring, or a special member for forming the first hook portion is not required.

Thus, the valve opening and closing timing control apparatus, which may securely apply the biasing force of the torsion spring, is configured without using a special process or parts.

As another configuration, the locking member may include an anti-separation portion configured to suppress separation of the second arm locked by the second hook portion in a direction along the rotation axis.

With this configuration, even if an external force is applied to separate the second arm locked by the locking member in the direction along the rotation axis, the anti-separation portion prevents the displacement and realizes reliable holding at the second hook portion.

As another configuration, the first hook portion may be a boss, which protrudes from a surface of the cover-shaped plate and has a female screw portion screwed to the fastening bolt therein.

With this configuration, the first arm may be locked by the first hook portion, which is configured with the boss having the female screw portion. In addition, because the boss does not rotate, unlike the head portion of the fastening bolt, a stable locking state may be maintained.

As another configuration, when a height of the first hook portion from the surface of the cover-shaped plate is assumed to a locking height H, a height of the second hook portion from the surface of the cover-shaped plate at a locking position is assumed to a reference height a, a distance between opposite end positions of a spring material in a close contact state of the torsion spring is assumed to a close contact length b, and a thickness of the spring material of the torsion spring in the direction along the rotation axis is assumed to a spring material thickness e, a lower limit value of the locking height H of the first hook portion may be set based on an equation of $H \geq a-b+(e/2)$.

The locking height H determined as described above is the lower limit value by which a state where the first arm is locked by the first hook portion may be maintained even when the torsion spring has reached a compressed state. For this reason, by simply setting the protrusion height of the first hook portion to a value slightly larger than the value of the locking height H obtained from the equation, even if the torsion spring may reach the compressed state by the action of an external force such as, for example, vibration, the first hook portion may be reliably maintained in the locked state by the first arm. In addition, with this configuration, the lower limit value of the locking height H from the surface of the cover-shaped plate of the hook portion may be acquired by a simple calculation based on the reference height a, the close contact length b, and the spring material thickness e.

As another configuration, when the relative rotation phase is displaced from a predetermined area among an area from a maximum advance phase to a maximum retardance phase, a positional relationship in which the first arm and the second arm overlap each other may appear when viewed in a direction along the rotation axis.

With this configuration, when the relative rotation phase is displaced to reach a positional relationship in which the second arm overlaps with the first arm, the second arm regulates displacement of the first arm in the lifting direction. Thus, the displacement of the first arm in the direction such that the first arm is lifted from the first hook portion is suppressed, and separation of the first arm from the first hook portion is suppressed.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening and closing timing control apparatus comprising:

a driving side rotator configured to rotate synchronously with a crankshaft of an internal combustion engine;

a driven side rotator disposed coaxially with a rotation axis of the driving side rotator and configured to rotate integrally with a valve opening and closing camshaft;

a phase controller configured to control a relative rotation phase between the driving side rotator and the driven side rotator by supply and discharge of a fluid; and a torsion spring configured to attain a biasing force to displace the relative rotation phase between the driving side rotator and the driven side rotator in a predetermined direction, wherein the driving side rotator is fastened to a cover-shaped plate, which accommodates the driven side rotator therein and covers the driven side rotator, via a fastening bolt, and a screwing structure that is screwed to the fastening bolt or a head portion of the fastening bolt is formed as a first hook portion that protrudes from the cover-shaped plate, the torsion spring includes a first arm provided on one end side thereof so as to be locked by the first hook portion and a second arm provided on a remaining end side thereof so as to be locked by a second hook portion of a locking member that rotates integrally with the camshaft, and when a height of the first hook portion from a surface of the cover-shaped plate is assumed to a locking height H, a height of the second hook portion from the surface of the cover-shaped plate at a locking position is assumed to a reference height a, a distance between opposite end positions of a spring material in a close contact state of the torsion spring is assumed to a close contact length b, and a thickness of the spring material of the torsion spring in a direction along the rotation axis is assumed to a spring material thickness e, a lower limit value of the locking height H of the first hook portion is set based on an equation of $H \geq a-b+(e/2)$.

2. The valve opening and closing timing control apparatus according to claim 1, wherein the locking member includes an anti-separation portion configured to suppress separation of the second arm locked by the second hook portion in a direction along the rotation axis.

3. The valve opening and closing timing control apparatus according to claim 1, wherein the first hook portion is a boss, which protrudes from a surface of the cover-shaped plate and has a female screw portion screwed to the fastening bolt therein.

4. The valve opening and closing timing control apparatus according to claim 1, wherein, when the relative rotation phase is displaced from a predetermined area among an area from a maximum advance phase to a maximum retardance phase, a positional relationship in which the first arm and the second arm overlap each other appears when viewed in a direction along the rotation axis.

* * * * *